US005219421A

United States Patent [19]

Tipping

[11] Patent Number: 5,219,421

[45] Date of Patent: Jun. 15, 1993

[54] PAPERBOARD TISSUE BOX WITH PAPERBOARD DISPENSER

[75] Inventor: Paul R. Tipping, Mississauga, Canada

[73] Assignee: Reid Dominion Packaging Limited, Ontario, Canada

[21] Appl. No.: 899,268

[22] Filed: Jun. 16, 1992

[51] Int. Cl.[5] ..... B65H 1/00

[52] U.S. Cl. ..... 221/63; 221/305; 206/233

[58] Field of Search ..... 221/47, 48, 63, 302, 221/305; 206/491, 233; 229/240-242

[56] References Cited

U.S. PATENT DOCUMENTS 2,323,395 7/1943 Harwood ..... 221/48
3,024,958 3/1962 Loderhose ..... 221/63
3,083,866 4/1963 Strange ..... 221/63 X
3,155,273 11/1964 Cote ..... 221/63
3,239,097 3/1966 Bates et al. ..... 221/48
3,258,156 6/1966 Smith ..... 221/63

*Primary Examiner*—David H. Bollinger
*Attorney, Agent, or Firm*—Staas & Halsey

[57] ABSTRACT

A tissue box for dispensing pop-up tissue is made entirely of paperboard. The dispensing portion of the box includes adjacent paperboard wings hinged at either end to the box by narrow neck portions. As tissues are withdrawn from the slit between the wings, the wings hinged outwardly alternating left to right as the interleaved tissues are dispensed. Being entirely of paperboard, the tissue box is environmental friendly and recyclable.

14 Claims, 4 Drawing Sheets

PAPERBOARD TISSUE BOX WITH PAPERBOARD DISPENSER

BACKGROUND OF THE INVENTION

1. Field of the Invention

This invention relates to a paperboard blank for forming a tissue dispensing box and the resulting tissue dispensing box.

2. Description of the Related Art

One type of tissue dispensing box contains interleaved tissues and a slitted plastic window which holds the top tissue in a pop-up or partially dispensed position ready for easy removal. When the top tissue is dispensed, the following tissue, being interleaved therewith, is pulled through the slit into a pop-up position. The window is a slitted plastic film patch adhered to the underside of the top panel of the box. The patch is of such an extent that a sufficient portion of the patch is exposed to a user so that the user may push his hand through the slit to grip the first tissue and move it to a pop-up position in order to ready a new tissue box for dispensing. One drawback with this known tissue box is that the plastic film of the dispenser is not environmentally friendly. A known alternative tissue dispensing box which avoids the plastic film has an enlarged opening through a portion of the top and one side of the box. A difficulty with such a box is that the dispensing opening does not have a pop-up feature for the tissues in the box.

This invention seeks to overcome drawbacks of known tissue dispensing boxes.

SUMMARY OF THE INVENTION

According to the present invention, there is provided a tissue dispensing paperboard box, comprising: a box panel having a slit therethrough for receiving tissues; a first peripheral slit through said box panel running along one side of said slit and having endpoints proximate said slit so as to form a first wing between said slit and said first peripheral slit, said first wing joined to said box by two necks, one neck between one of said endpoints of said first peripheral slit and said slit and the other neck between the other of said endpoints of said first peripheral slit and said slit; and a second peripheral slit through said box panel running along the other side of said slit and having endpoints proximate said slit so as to form a second wing between said slit and said second peripheral slit, said second wing joined to said box by two necks, one neck between one of said endpoints of said second peripheral slit and said slit and the other neck between the other of said endpoints of said second peripheral slit and said slit, whereby said necks act as hinges permitting said first and second wings to pivot to facilitate dispensing.

According to another aspect of the present invention, there is provided a paperboard blank having a number of panels for forming a tissue dispensing box, said blank comprising: a panel having a slit therethrough; a first peripheral slit through said panel running along one side of said slit and having endpoints proximate said slit so as to form a first wing between said slit and said first peripheral slit, said first wing joined to said panel by two necks, one between each of said endpoints of said first peripheral slit and said slit; and a second peripheral slit through said panel running along the other side of said slit and having endpoints proximate said slit so as to form a second wing between said slit and said second peripheral slit, said second wing joined to said panel by two necks, one between each of said endpoints of said second peripheral slit and said slit.

BRIEF DESCRIPTION OF THE DRAWINGS

In the figures which disclose example embodiments of the invention.

DESCRIPTION OF THE PREFERRED EMBODIMENTS

Figure 1:
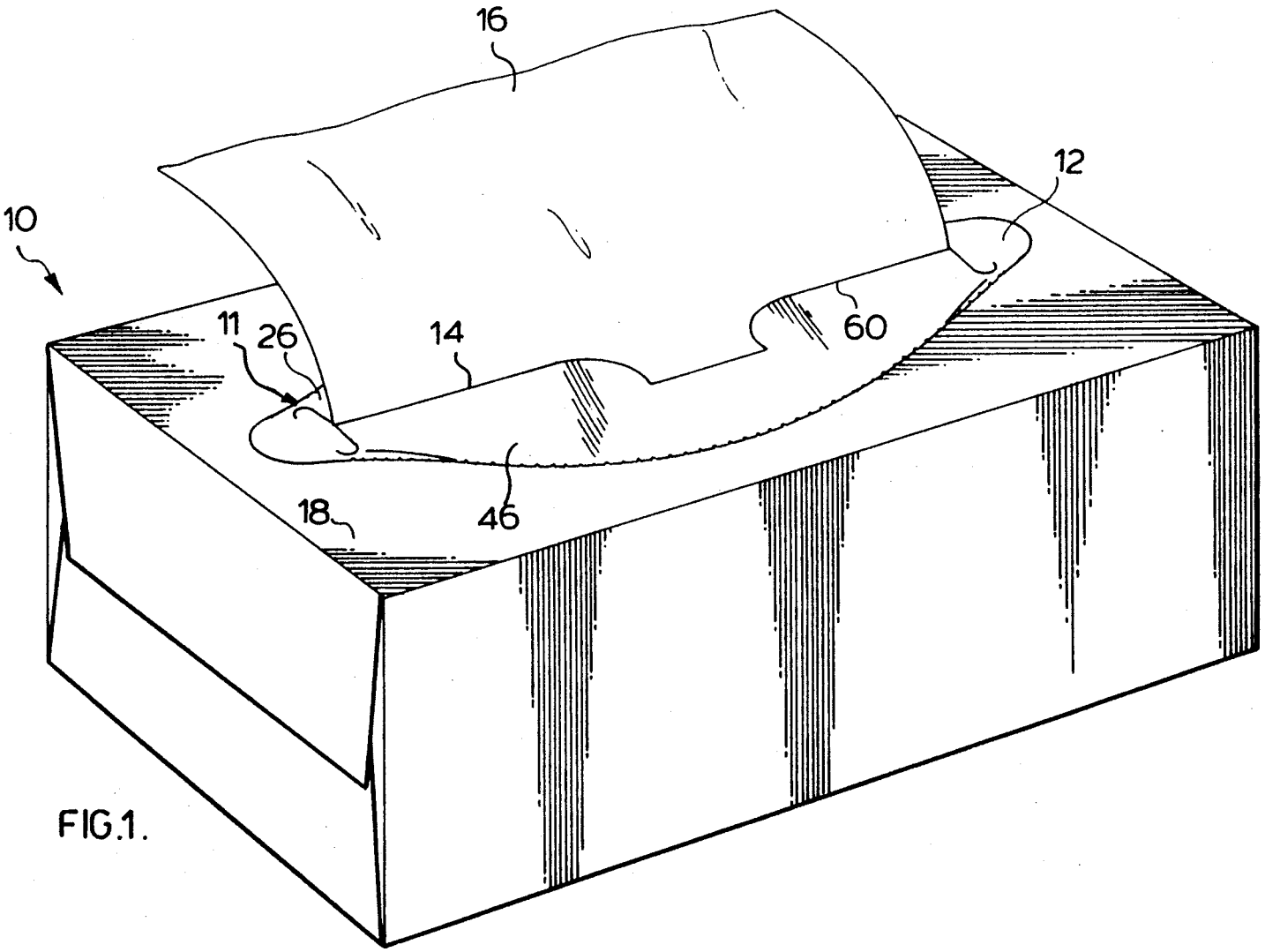
FIG. 1 is a perspective view of a tissue box made in accordance with this invention.

With reference to FIG. 1, a tissue dispensing box 10 has a panel 12 having a tissue dispenser indicated generally at 11. The dispenser 11 comprises a slit 14 through panel 12 for receiving a tissue 16. As it will become clear hereinafter, panel 12 underlies top panel 18 of the box 10.

Figure 2:
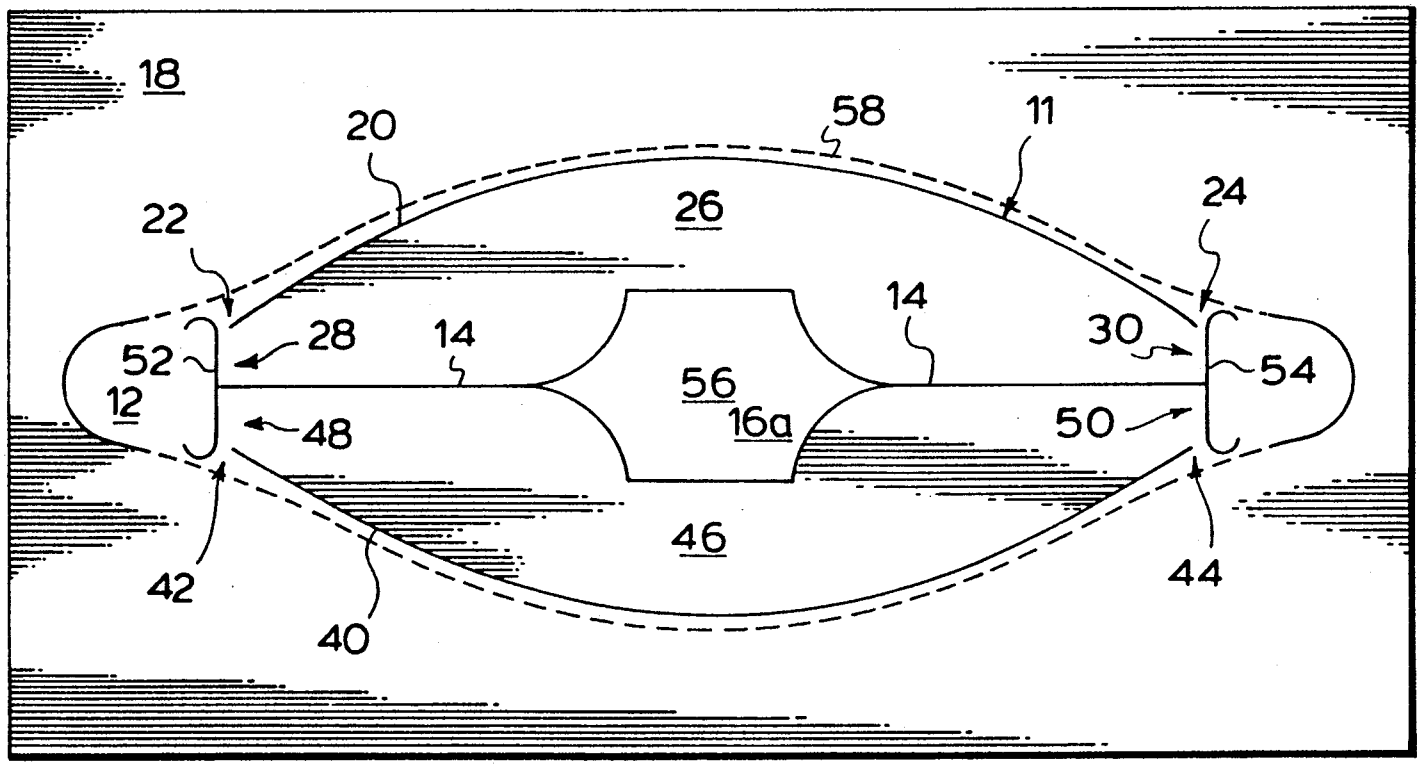
FIG. 2 is a top view of the tissue dispensing of FIG. 1.

Turning to FIG. 2, which shows the top of box 10 without a tissue received in slit 14, dispenser 11 of panel 12 also includes a first peripheral slit 20 which runs along one side of slit 14 and has end points 22 and 24 proximate slit 14 so as to form a first wing 26 between the slit 14 and the first peripheral slit 20 joined to the remainder of panel 12 by neck portions 28 and 30. Similarly, a second peripheral slit 40 running along the opposite side of slit 14 and having end points 42 and 44 proximate slit 14 form a second wing 46 between the slit 14 and the second peripheral slit 40 joined to panel 12 by necks 48 and 50.

Wings 26 and 46 taper toward each of their necks 28, 30 and 48, 50, respectively. Together, the wings outline a generally elliptical shape.

Slit 14 runs in the longitudinal direction of the box and extends in this longitudinal direction beyond the end points 22, 42 and 24, 44 of the first and second peripheral slits 20 and 40. The slit 14 terminates at either end in lateral slits 52 and 54. These lateral slits extend in a lateral direction past the end points 22, 42 and 24, 44 of the two peripheral slits. These lateral slits 52 and 54 increase the length of necks 28, 48, and 30, 50, respectively. Slits 52 and 54 have curved ends to reduce the likelihood of tearing and to ease the outward hinging of wings 26 and 46 when tissue is dispensed.

Slit 14 is interrupted by a medial opening 56 through panel 12.

Opening 58 in top panel 18 of the box exposes the wings and slits of panel 12.

In use, with reference first to FIG. 2, a top tissue **16*a* of an interleaved pile of tissues within box 10 may be moved to a pop-up position by a user inserting his hand through opening 56 of dispenser 11 and drawing the top tissue 16*a* partially through slit 14 to the position shown in FIG. 1. As tissue 16*a* is withdrawn to this pop-up position, wings 26 and 46 may hinge about necks 28, 30 and 48, 50 respectively, to facilitate this partial withdrawal of the tissue. Once a tissue 16 is in the pop-up position shown in FIG. 1, tissues may be withdrawn from the box 10 and the wings 46 and 26 will hinge outwardly alternating left to right as the interleaved tissues are dispensed. As before noted, the necks joining the wings to panel 12 are what allow wings 26 and 46 to hinge. FIG. 1 shows wing 46 in a partially hinged position so that its inside edge 60 is above the inside edge of wing 26**.

As detailed hereinafter, opening 58 in top panel 18 may receive a detachable cover.

Figure 3:
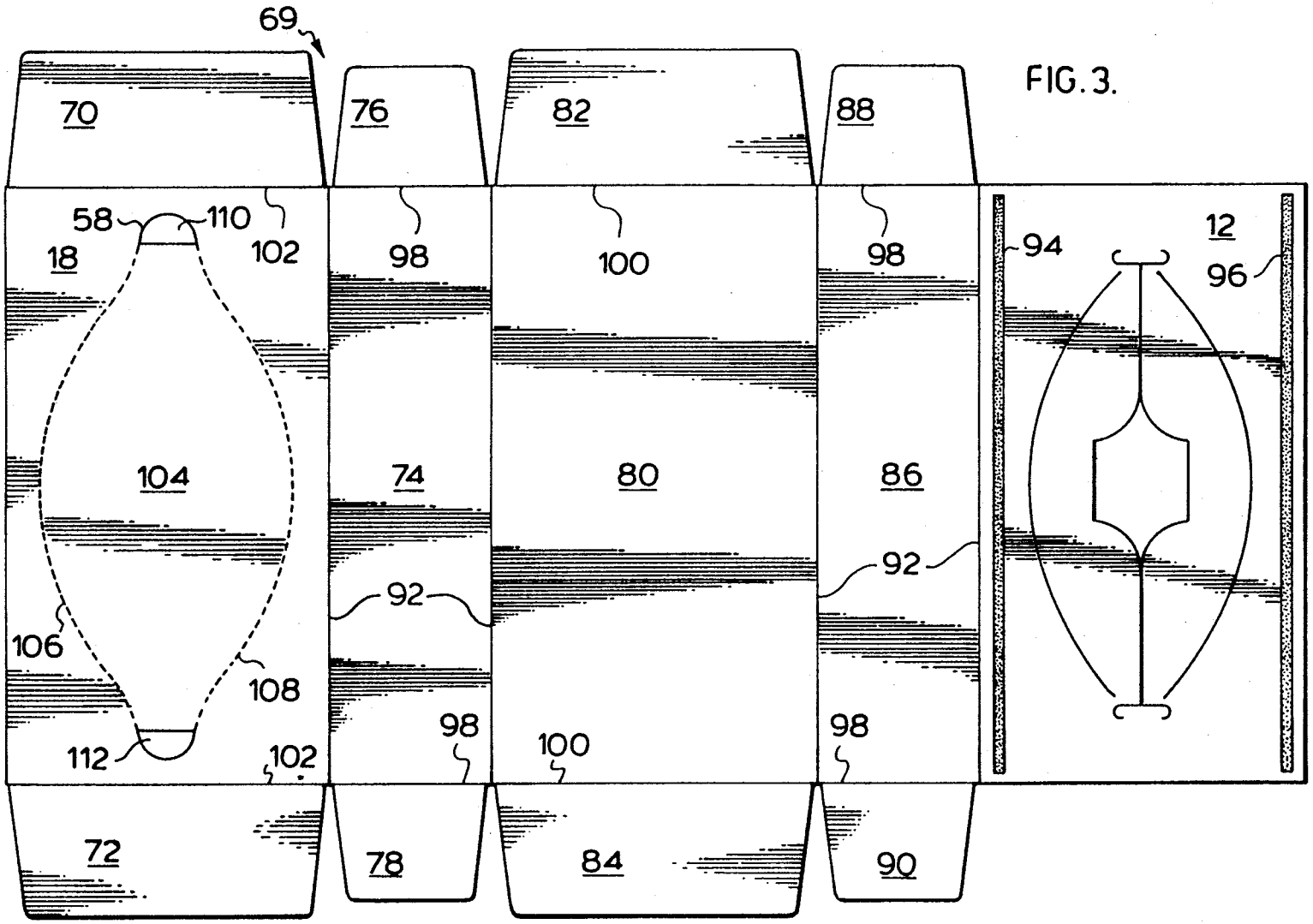
FIG. 3 is a plan view of a blank from which the box of FIG. 1 is made.
Figure 4:
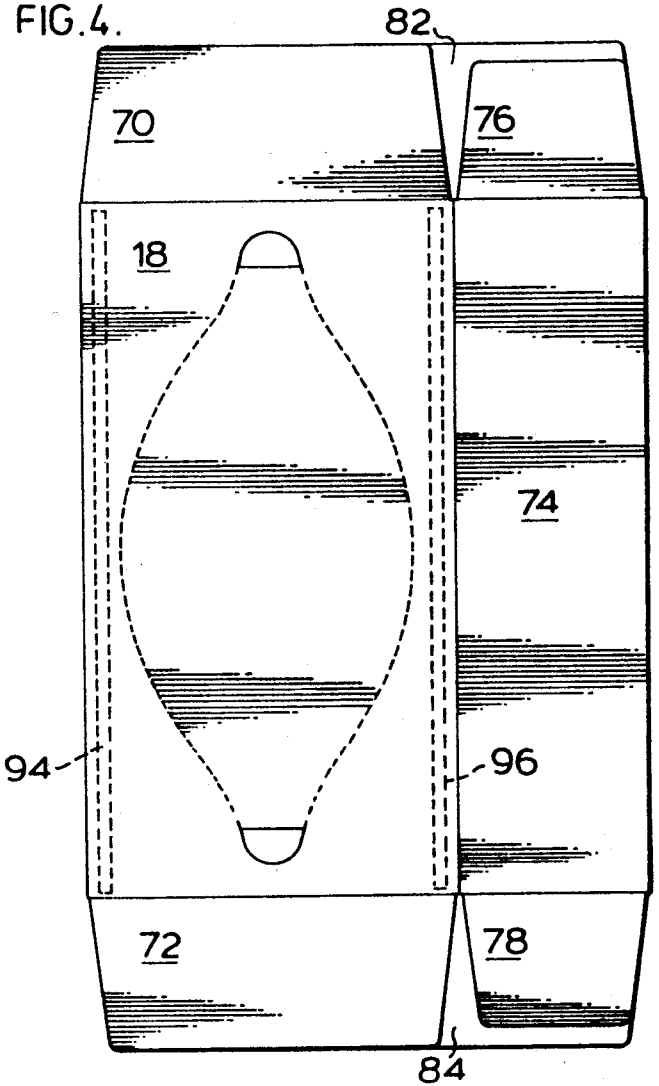
FIG. 4 is a plan view of a partially folded blank of FIG. 3.
Figure 5:
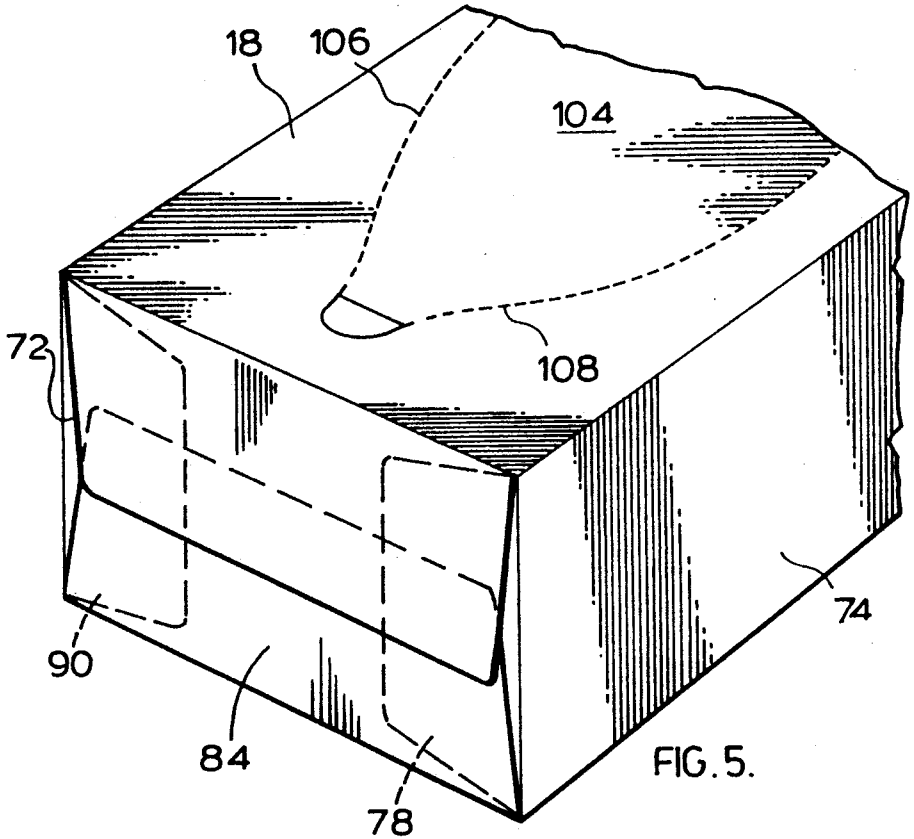
FIG. 5 is a partial perspective view of a folded and sealed blank of FIG. 3.

FIG. 3 shows a blank 69 from which the box of FIGS. 1 and 2 may be formed. The blank is made of paperboard and has a number of panels, namely, top panel 18 which is hinged to end flaps 70 and 72 and side panel 74. Side panel 74 is, in turn, hinged to side flaps 76 and 78 and a bottom panel 80. Bottom panel 80 is also hinged to end flaps 82 and 84 and to side panel 86. Side panel 86 is also hinged to side flaps 88 and 90 and to panel 12. To assemble the blank 69, glue is applied along lines 94 and 96 on panel 12 and panels 18, 74, 80, 86, and 12 are folded at seams 92 so that panel 12 underlies panel 18. Panel 12 is then adhered to the undersurface of panel 18 by glue lines 94 and 96. FIG. 4 illustrates the blank after this step has been taken. Side flaps 76, 78, and 88, 90 may then be folded about seams 98 and subsequently, end flaps 82 and 84 folded along seams 100 to overlie the folded side flaps. Lastly, end flaps 70 and 72 may be folded about seams 102 to overlie the side flaps and end flaps 82 and 84. Prior to this last step, a glue line is formed on the undersurface of end flaps 70 and 72 so that these flaps adhere to flaps 82 and 84 to thereby hold the flaps in position. FIG. 5 illustrates the completed box once this step has been taken.

It will be noted that top panel 18 incorporates a cover 104 which is detachably attached to the top panel by perforated lines 106 and 108. When the blank has been assembled into the box of FIG. 5, cover 104 covers the slits of panel 12. The cover 104 terminates sort of covering all of opening 58 so as to provide areas 110 and 112 whereat a user may grip the cover 104 to detach it from panel 18.

Blank 69 may be die cut. Since the blank and resulting tissue box are made entirely of paperboard, the tissue box is environmental friendly and readily recyclable.

Modifications will be apparent to those skilled in the art and, therefore, the invention is defined in the claims.

What is claimed is:

1. A tissue dispensing paperboard box, comprising:

a box panel having a slit therethrough for receiving tissues;

a first peripheral slit through said box panel running along one side of said slit and having endpoints proximate said slit so as to form a first wing between said slit and said first peripheral slit, said first wing joined to said box by two necks, one neck between one of said endpoints of said first peripheral slit and said slit and the other neck between the other of said endpoints of said first peripheral slit and said slit; and a second peripheral slit through said box panel running along the other side of said slit and having endpoints proximate said slit so as to form a second wing between said slit and said second peripheral slit, said second wing joined to said box by two necks, one neck between one of said endpoints of said second peripheral slit and said slit and the other neck between the other of said endpoints of said second peripheral slit and said slit, whereby said necks act as hinges permitting said first and second wings to pivot to facilitate dispensing.

2. The tissue dispensing box of claim 1 wherein said first wing and said second wing taper toward each of said two necks.

3. The tissue dispensing box of claim 2 wherein said slit runs longitudinally along said box panel and extends longitudinally beyond said endpoints of said first and second peripheral slits.

4. The tissue dispensing box of claim 3 wherein said slit terminates at either end in a lateral slit through said box panel which extends laterally beyond the endpoints of said first and second peripheral slits so as to increase the length of each of said necks of said first and second wings.

5. The tissue dispensing box of claim 4 comprising a central opening interrupting said slit for facilitating access to a tissue when no tissue extends through said slit.

6. The tissue dispensing box of claim 5 including a detachable cover for covering each of said slits on said box panel.

7. A paperboard blank having a number of panels for forming a tissue dispensing box, said blank comprising:

a panel having a slit therethrough;

a first peripheral slit through said panel running along one side of said slit and having endpoints proximate said slit so as to form a first wing between said slit and said first peripheral slit, said first wing joined to said panel by two necks, one between each of said endpoints of s id first peripheral slit and said slit; and a second peripheral slit through said panel running along the other side of said slit and having endpoints proximate said slit so as to form a second wing between said slit and said second peripheral slit, said second wing joined to said panel by two necks, one between each of said endpoints of said second peripheral slit and said slit.

8. The blank of claim 7 wherein said first wing and said second wing taper from a medial wider portion toward each of said two necks.

9. The blank of claim 8 wherein said slit runs longitudinally along said panel and extends longitudinally beyond said endpoints of said first and second peripheral slits.

10. The blank of claim 9 wherein said slit terminates at either end in a lateral slit through said panel which extends laterally beyond the endpoints of said first and second peripheral slits so as to increase the length of each of said necks of said first and second wings.

11. The blank of claim 10 comprising a central opening interrupting said slit.

12. The blank of claim 11 including a further panel with a cover attached by perforations to said further panel, said panel for underlying said further panel so that said cover covers each of said slits on said panel.

13. The blank of claim 7 including a first panel for forming a top panel in a tissue dispensing box hinged to a second panel for forming a side panel in a tissue dispensing box hinged to a third panel for forming a bottom panel in a tissue dispensing box hinged to a fourth panel for forming another side panel in a tissue dispensing box hinged to said panel, such that said panel is adapted to underlie said first panel, said first panel comprising an opening to expose said first wing and said second wing of said panel.

14. The blank of claim 13 wherein said first panel further includes a detachable cover for covering at least a portion of said opening in said first panel.

* * * * *